US005396847A

United States Patent [19]

Scott

[11] Patent Number: 5,396,847

[45] Date of Patent: Mar. 14, 1995

[54] MULTI-LEVEL FOLDAWAY DISPLAY STRUCTURES

[76] Inventor: Roy E. Scott, 414 Locust St., Erlanger, Ky. 41018

[21] Appl. No.: 224,586

[22] Filed: Apr. 9, 1994

[51] Int. Cl.[6] ..... A47B 57/00

[52] U.S. Cl. ..... 108/101; 108/92

[58] Field of Search ..... 108/92, 97, 99, 100, 108/101, 111; 312/204

[56] References Cited

U.S. PATENT DOCUMENTS

| | | | |
|---|---|---|---|
| 168,715 | 10/1875 | Buck | 108/92 |
| 1,012,959 | 12/1911 | Zaharis | 108/92 |
| 5,165,637 | 11/1992 | Polley et al. | 108/101 |

FOREIGN PATENT DOCUMENTS

| | | | |
|---|---|---|---|
| 1006567 | 4/1952 | France | 108/100 |
| 0011910 | of 1904 | United Kingdom | 108/101 |

*Primary Examiner*—Kenneth J. Dorner
*Assistant Examiner*—Gerald A. Anderson

[57] ABSTRACT

A multi-level foldaway display structure comprising a first component which takes a planar orientation when disassembled or an inverted boxlike shape when folded and having apertures, a second component which takes a planar orientation when disassembled or a inverted boxlike shape when folded and having apertures at the margins which align with apertures in the first component when the second component is positioned on the first component, a third component on the form of a planar sheet having apertures inboard of a periphery for coupling with the first component when the first component is positioned on the third component. Coupling pins extend through aligned apertures of different components, said pin comprising a pair of spring urged arms having a pair of planar shoulders extending therefrom, the shoulders being positioned beneath the lowermost of a pair the aligned apertures and the pin having an upper component having a lower surface to be placed in contact with the uppermost surface of the aligned apertures.

4 Claims, 2 Drawing Sheets

FIG. 1
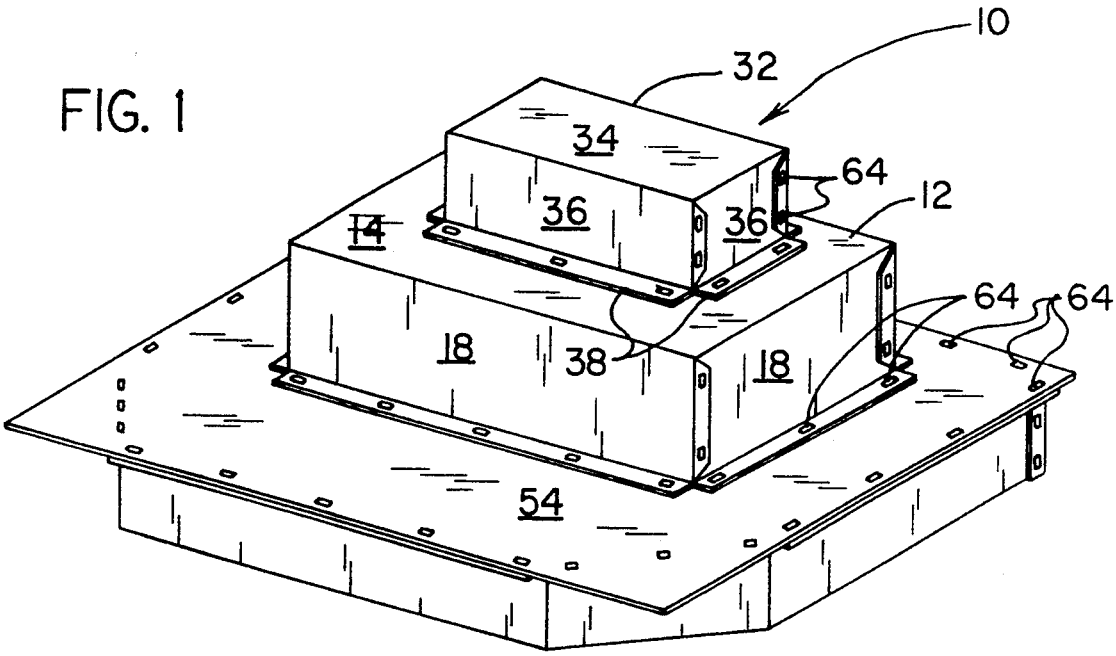
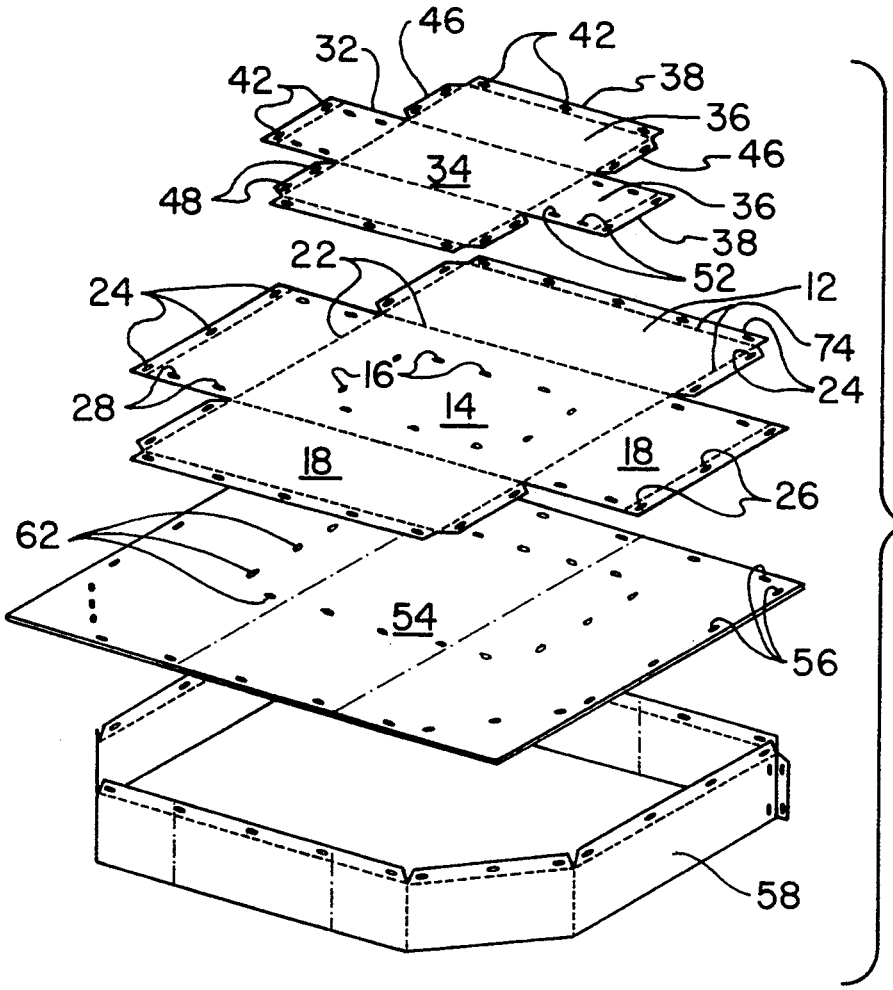
FIG. 2

FIG. 3
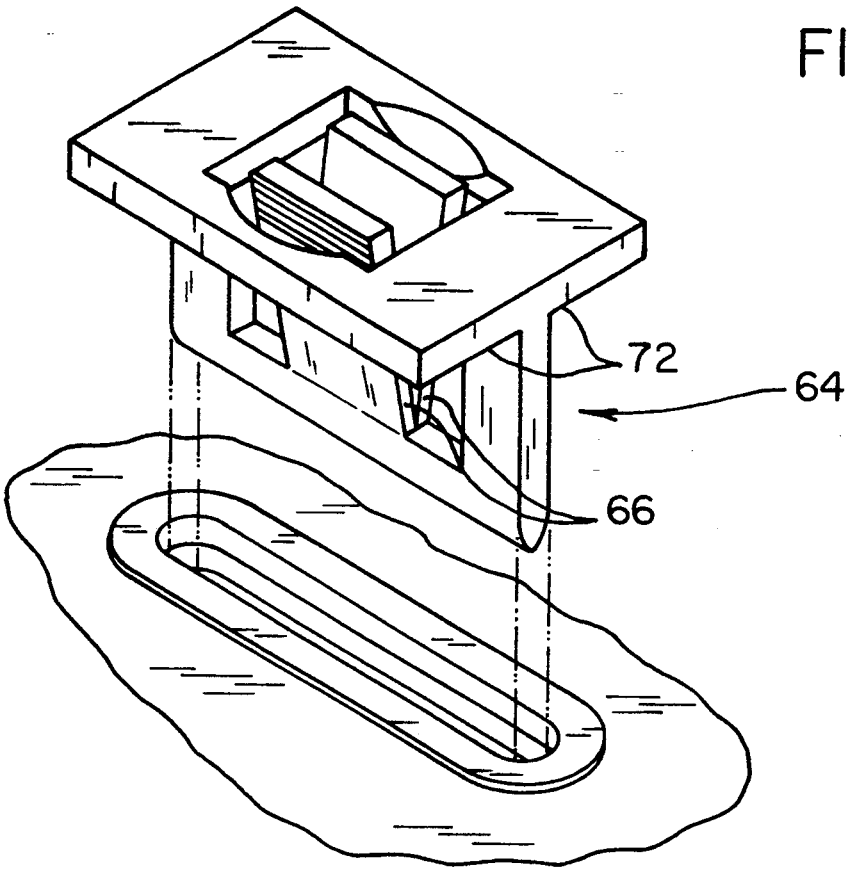
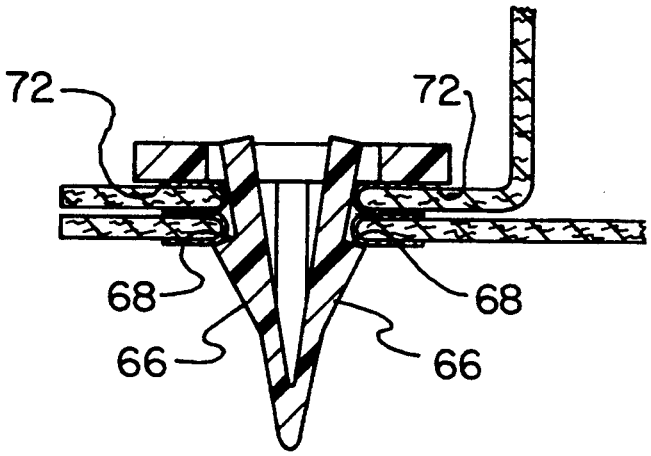
FIG. 4

MULTI-LEVEL FOLDAWAY DISPLAY STRUCTURES

BACKGROUND OF THE INVENTION

1. Field of the Invention

The present invention relates to new and improved multi-level foldaway display structures and more particularly pertains to displaying items on a multi-level platform which is readily assembled and disassembled.

2. Description of the Prior Art

The use of display structures is known in the prior art. More specifically, display structures heretofore devised and utilized for the purpose of displaying items on multi-level structures are known to consist basically of familiar, expected, and obvious structural configurations, notwithstanding the myriad of designs encompassed by the crowded prior art which has been developed for the fulfillment of countless objectives and requirements.

The prior art discloses a large number of display structures. By way of example, U.S. Pat. No. 3,674,612 to Gehl discloses a folding Christmas tree type of display stand.

U.S. Pat. No. 4,344,242 to Reszka discloses an animated Christmas display device.

U.S. Pat. No. 5,067,543 to Bove discloses a foldable display system with continuous display surface.

U.S. Pat. No. Des. 258,160 to Williams discloses a combined toy harbor, village and figure therefor.

Lastly, U.S. Pat. No. Des. 308,894 to Tsai discloses a display stand for Christmas decorations and the like.

In this respect, multi-level foldaway display structures according to the present invention substantially depart from the conventional concepts and designs of the prior art, and in doing so provide an apparatus primarily developed for the purpose of displaying items on a multi-level platform which is readily assembled and disassembled.

Therefore, it can be appreciated that there exists a continuing need for new and improved multi-level foldaway display structures which can be used for displaying items on a multi-level platform which is readily assembled and disassembled. In this regard, the present invention substantially fulfills this need.

SUMMARY OF THE INVENTION

In view of the foregoing disadvantages inherent in the known types of display structures now present in the prior art, the present invention provides improved multi-level foldaway display structures. As such, the general purpose of the present invention, which will be described subsequently in greater detail, is to provide new and improved multi-level foldaway display structures and methods which have all the advantages of the prior art and none of the disadvantages.

To attain this, the present invention essentially comprises a new and improved multi-level foldaway display structure comprising, in combination, a first component positionable in a planar orientation when disassembled but adapted to be conformed into an inverted boxlike shape, the first component having a rectangular central portion with apertures extending therethrough for coupling with mating apertures in a higher mating component thereabove, the central portion also having rectangular subportions extending outwardly from each of the four sides of the rectangular central portion, the edges of the four subcomponents remote from the central portion having primary tabs parallel with the lines of coupling to the central rectangular portion and having apertures extending therethrough for coupling with apertures in the upper extent of a third component positionable therebeneath, supplemental tabs on at least some of the supplemental components perpendicular to the primary tabs with apertures extending therethrough and mating apertures in the adjacent edges for coupling the subcomponents together to form an inverted boxlike shape; a second component positionable in a planar orientation when disassembled but adapted to be conformed into an inverted boxlike shape, the second component having a rectangular central portion, the central portion also having rectangular subportions extending outwardly from each of the four sides of the rectangular central portion, the edges of the four subcomponents remote from the central portion having primary tabs parallel with the lines of coupling to the central rectangular portion and with apertures extending therethrough for coupling with apertures in the upper extent of a third component positionable therebeneath, supplemental tabs on at least some of the supplemental components perpendicular to the primary tabs with apertures extending therethrough and mating apertures in the adjacent edges for coupling the subcomponents together to form an inverted boxlike shape, the second component being smaller than the first component; a third component in the form of a planar sheet having apertures extending therethrough around the periphery thereof for coupling to a component therebeneath and having a second set of apertures extending therethrough inboardly of the periphery for being coupled with the first component thereabove; coupling pins adapted to extend through facing apertures of different components comprising a pair of spring urged arms having a central axis with planar shoulders extending outwardly therefrom, the shoulders being positioned beneath the lowermost surface of the lowermost aligned apertures and with an upper component having a lower surface adapted to be placed in contact with the uppermost surface of the uppermost of aligned apertures; the sheet material being fabricated of a class of planar sheet materials including cardboard, styrofoam and plywood; and the area of bending within each of the components being effective through fold lines including serrations, scores and hinges.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved multi-level foldaway display structures which have all the advantages of the prior art display structures and none of the disadvantages.

It is another object of the present invention to provide new and improved multi-level foldaway display structures which may be easily and efficiently manufactured and marketed.

It is a further object of the present invention to provide new and improved multi-level foldaway display structures which are of a durable and reliable construction.

An even further object of the present invention is to provide new and improved multi-level foldaway display structures which are susceptible of a low cost of manufacture with regard to both materials and labor, and which accordingly are then susceptible of low prices of sale to the consuming public, thereby making such multi-level foldaway display structures economically available to the buying public.

Still yet another object of the present invention is to provide new and improved multi-level foldaway display structures which provide in the apparatuses and methods of the prior art some of the advantages thereof, while simultaneously overcoming some of the disadvantages normally associated therewith.

Even still another object of the present invention is to display items on a multi-level platform which is readily assembled and disassembled.

Lastly, it is an object of the present invention to provide a multi-level foldaway display structure comprising a first component positionable in a planar orientation when disassembled but adapted to be conformed into an inverted boxlike shape, the first component having a central portion with apertures extending therethrough for coupling with mating apertures in a higher mating component thereabove, the central portion also having subportions extending outwardly from each of the sides of the central portion, the edges of the subcomponents remote from the central portion having primary tabs parallel with the lines of coupling to the central portion and having apertures extending therethrough for coupling with apertures in the upper extent of a third component positionable therebeneath, supplemental tabs on at least some of the supplemental components perpendicular to the primary tabs with apertures extending therethrough and mating apertures in the adjacent edges for coupling the subcomponents together to form an inverted boxlike shape; a second component positionable in a planar orientation when disassembled but adapted to be conformed into an inverted boxlike shape, the second component having a central portion, the central portion also having subportions extending outwardly from each of the sides of the central portion, the edges of the subcomponents remote from the central portion having primary tabs parallel with the lines of coupling to the central portion and with apertures extending therethrough for coupling with apertures in the upper extent of a third component positionable therebeneath, supplemental tabs on at least some of the supplemental components perpendicular to the primary tabs with apertures extending therethrough and mating apertures in the adjacent edges for coupling the subcomponents together to form an inverted boxlike shape, the second component being smaller than the first component; a third component in the form of a planar sheet having apertures extending therethrough around the periphery thereof for coupling to a component therebeneath and having a second set of apertures extending therethrough inboardly of the periphery for being coupled with the first component thereabove; and coupling pins adapted to extend through facing apertures of different components comprising a pair of spring urged arms having a central axis with planar shoulders extending outwardly therefrom, the shoulders being positioned beneath the lowermost surface of the lowermost aligned apertures and with an upper component having a lower surface adapted to be placed in contact with the uppermost surface of the uppermost of aligned apertures.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the new and improved multi-level foldaway display structure constructed in accordance with the principles of the present invention.

FIG. 2 is a perspective illustration of the system as set forth in FIG. 1 but in the collapsed orientation.

FIG. 3 is an exploded perspective illustration of the coupling mechanisms used for joining the components of the system of FIGS. 1 and 2.

FIG. 4 is a cross-sectional view taken along line 4—4 of FIG. 3.

The same reference numerals refer to the same parts throughout the various Figures.

DESCRIPTION OF THE PREFERRED EMBODIMENT

With reference now to the drawings, and in particular to FIGS. 1 through 4 thereof, the preferred embodiment of the new and improved multi-level foldaway display structures embodying the principles and concepts of the present invention and generally designated by the reference numeral 10 will be described.

The present invention, the new and improved multilevel foldaway display structure, is a system 10 comprised of a plurality of components. The principal components are a first planar component, a second planar component and a third planar component and coupling pins for interconnecting the various planar components. The individual components of the system 10 are configured individually and interrelated one with another so as to achieve the intended objectives.

More specifically, the first planar component 12 is adapted to take a planar orientation when disassembled. It is, however, adapted to be configured and conformed into an inverted boxlike shape during operation and use. Such first planar component has a rectangular central portion 14. Such central portion is provided with apertures 16 extending therethrough in a rectangular configuration. Such apertures are adapted for coupling with mating apertures in a mating component at a higher elevation thereabove. The central portion also has rectangular subportions 18 extending outwardly from each of the four sides of the rectangular central portion. The edges of the subcomponents remote from the central portion have primary tabs parallel with the lines of coupling 22 to the central rectangular portion. Such primary tabs are also provided with apertures 24 extending therethrough. Such apertures are for coupling with mating apertures in the upper extent of a third planar component positionable therebeneath.

In addition, supplemental tabs 26 are provided on at least some of the supplemental components perpendicular to the primary tabs. Such supplemental tabs are also provide with apertures extending therethrough. Mating apertures 28 are formed in the adjacent edges for coupling the subcomponents together to form an inverted boxlike shape.

The second planar component 32 is similar in shape to the first planar component. It is, however, reduced in size in all aspects except for the size of the apertures. The second component is in a planar configuration when disassembled. It is, however, adapted to be conformed into an inverted boxlike shape when assembled. The second component has a rectangular central portion 34. The central portion also has rectangular subportions 36 extending outwardly from each of the four sides of the rectangular central portion. The edges of the four subcomponents remote from the central portion have primary tabs 38 parallel with the lines of coupling to the central rectangular portion. Such supplemental tabs have apertures 42 extending therethrough for coupling with apertures 16 in the upper extent of the first component positionable beneath the second component.

Supplemental tabs 46 are also provided on at least some of the supplemental components perpendicular to the primary tabs. Apertures 48 extend therethrough. Further, mating apertures 52 in the adjacent edges of the supplemental components are for coupling the supplemental components together to form an inverted boxlike shape. As mentioned above, the second component is similar in shape to the first planar component but of a reduced size in all aspects except for the size of the apertures which are the same.

A third component 54 is in the form of a planar sheet. Such sheet has apertures 56 extending therethrough around the periphery of the planar sheet. Such apertures are for coupling with a supplemental component 58 therebeneath. The third component has a second set of apertures 62 extending therethrough. Such second set of apertures are located inboardly of the periphery of the third planar component for effecting the coupling with the first component located thereabove.

In the primary embodiment, the coupling between the various planar components when configured for operation and use is effected through coupling pins 64. Such pins are adapted to extend through facing apertures of different components. Such pins comprise a pair of spring-urged arms 66. Such arms have a central axis with planar shoulders 68 extending outwardly therefrom. The shoulders are positionable beneath the lowermost surface of the lowermost of the apertures being coupled. The pins each have an upper region with a lower surface 72 adapted to be placed in contact with the uppermost surface of the uppermost of the aligned apertures. Coupling between facing apertures is thus effected by simply pushing the pin through the aligned apertures. The walls of the apertures will force the legs of the pins toward each other until the pin is fully seated in its operative position. Removable of the pins is easily effected by reaching underneath the pin, pinching the legs together and then pushing the pin outwardly from the aperture or pulling it outwardly from the aperture from the exposed side.

The present invention can be fabricated from a wide variety of materials preferably cardboard. It should be understood, however, that any material from the class of sheet material including cardboard, styrofoam and plywood could readily be utilized. It should be further understood that the area of bending within each of the components may be effected through fold lines 74. The fold lines may be defined by any of the known fold lines including serrations, score lines and hinges.

Although not absolutely necessary for the proper construction and functioning of the present invention, it is preferred to facilitate the storing away of the disassembled and flattened sheets by providing supplemental fold lines. Such fold lines preferably extend across the entire width of those sheets of extended size. Such fold lines are different from the fold lines and adjacent the periphery of the sheets which are necessary for the coupling together of the sheets. The supplemental fold lines can be seen in FIG. 2 as dash-dot lines in sheets 54 and 58. They are parallel with the remote edges thereof and perpendicular with the adjacent edges thereof.

Lastly, while the preferred embodiment as disclosed employs rectangular members symmetrically stacked one on top of the other, the central portion of any of the planar sheets could take a wide variety of other shapes such as triangles, pentagons or the like, regular in shape or irregular in shape. Further, although the various components are shown stacked symmetrically one above the other, various configurations could be utilized as by locating an upper component to one side or toward one corner of the associated component therebeneath.

The present invention provides a prefabricated and reusable base for displaying a scenic holiday village. Conventional methods of setting up a display require painstaking details, especially in building the base. This invention is essentially a timesaving item that provides the means to quickly set up a preassembled base.

This concept can be applied to bases of various shapes that fit into different areas. It is designed to fit on windowsills, bay windows and virtually any other location. It is made of sturdy pressed paper, plywood or other suitable material. The pressed paper version folds along a crease and is assembled using tabs and slots, while the plywood version requires a hinge. Other materials that this invention could be made from include styrofoam and plastic. The present invention incorporates a rectangular shape so it will fit nicely into a windowsill. The edges can be trimmed to adjust to the space available. The corners can be cut to fit into a bay or bow-style window. Optional tiers can be incorporated to form hills and valleys. Up to three tiers may be included and attached using a system of tabs and slots.

Once the base has been laid out in the manner desired, the tiers and the base can be painted or covered with a suitable material. A green or white felt can be used to simulate grass or snow. Other topographical features, such as hills, ponds, skating rinks, etc. can be included and are limited only by the user's imagination.

The present invention is ideal for use in the home, as well as in commercial applications. This display will be a timesaver to businesses that have holiday displays in their windows. It can be used over for many holidays and other occasions. The present invention is easy to assemble and disassemble, requires no special tools or skills and requires little storage space.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A multi-level foldaway display structure comprising, in combination:

a first component positionable in a planar orientation when disassembled but foldable into an inverted boxlike shape, the first component having a rectangular central portion with apertures extending therethrough for coupling with mating apertures in a mating component thereon, the central portion having four side edges rectangular subportions extending outwardly from each of the four side edges of the rectangular central portion, the edges of the four subcomponents remote from the central portion having primary tabs parallel with the respective side edges the central rectangular portion and having tab apertures extending therethrough for coupling with apertures in the upper extent of a third component beneath said first component, supplemental tabs on at least some of the subcomponent perpendicular to the primary tabs with apertures extending therethrough and mating apertures in adjacent edges of the subcomponents for coupling the subcomponents together to form said inverted boxlike shape;

a second component positionable in a planar orientation when disassembled but foldable into an inverted boxlike shape, the second component having a rectangular central portion, the central portion having four side edges rectangular subportions extending outwardly from each of the four side edges of the rectangular central portion, the edges of the four subcomponents remote from the central portion having primary tabs parallel with the respective side edge of the central rectangular portion and tab apertures extending therethrough for coupling with apertures in the upper extent of a the first component positionable therebeneath, supplemental tabs on at least some of the supplemental components perpendicular to the primary tabs with apertures extending therethrough and mating apertures in adjacent edges of the subcomponents for coupling the subcomponents together to form an inverted boxlike shape, the second component being smaller than the first component;

a third component in the form of a planar sheet having apertures extending therethrough around the periphery thereof for coupling to a fourth component therebeneath and having a second set of apertures extending therethrough inboardly of the periphery for being coupled with the first component thereabove;

coupling pins adapted to extend through coupling apertures of different components comprising a pair of spring urged arms having a central axis with planar shoulders extending outwardly therefrom, the shoulders being positioned beneath a lowermost surface of the lowermost aligned apertures and with an upper component having a lower surface adapted to be placed in contact with a uppermost surface of the uppermost of aligned apertures;

the components being fabricated of a class of planar sheet materials including cardboard, styrofoam and plywood; and an area of bending within each of the components being effective through fold lines which may be serrations, scores or hinges.

2. A multi-level foldaway display structure comprising:

a first component positionable in a planar orientation when disassembled but foldable into an inverted boxlike shape, the first component having a central portion with apertures extending therethrough for coupling with mating apertures in a second component thereon, the central portion having four side edges subportions extending outwardly from each of the side edges of the central portion, the edges of the subcomponents a subcomponent edge remote from the central portion having primary tabs parallel with the respective side edges of lines of the central portion and having tab apertures extending therethrough for coupling with apertures in a upper extent of a third component beneath said first component, supplemental tabs on at least some of the subcomponents perpendicular to the primary tabs with apertures extending therethrough and mating apertures in adjacent edges of the subcomponents for coupling the subcomponents together to form said inverted boxlike shape;

a second component positionable in a planar orientation when disassembled but foldable into an inverted boxlike shape, the second component having a central portion, the central portion having four side edges, having subportions extending outwardly from each of the side edge of the central portion, subcomponents edges remote from the central portion having primary tabs parallel with the respective side edge of the central portion and with tab apertures extending therethrough for coupling with apertures in the upper extent of the first component positionable therebeneath, supplemental tabs on at least some of the supplemental components perpendicular to the primary tabs with apertures extending therethrough and mating apertures in adjacent edges of the subcomponents for coupling the subcomponents together to form an inverted boxlike shape, the second component being smaller than the first component;

a third component in the form of a planar sheet having apertures extending therethrough around the periphery thereof for coupling to a fourth component therebeneath and having a second set of apertures extending therethrough inboardly of the periphery for being coupled with the first component thereabove; and coupling pins adapted to extend through coupling apertures of different components comprising a pair of spring urged arms having a central axis with planar shoulders extending outwardly therefrom, the shoulders being positioned beneath a lowermost surface of the lowermost aligned apertures and with an upper component having a lower surface adapted to be placed in contact with a uppermost surface of the uppermost of aligned apertures.

3. The device as set forth in claim 2 wherein the sheet material is fabricated of a class of planar sheet materials including cardboard, styrofoam and plywood.

4. The device as set forth in claim 2 wherein the area of bending within each of the components is effected through fold lines of the class including serrations, scores and hinges.

* * * * *